US007654518B2

(12) United States Patent
Kim et al.

(10) Patent No.: US 7,654,518 B2
(45) Date of Patent: Feb. 2, 2010

(54) IMAGE FORMING APPARATUS AND PAPER GUIDE UNIT THEREOF

(75) Inventors: Jong Tae Kim, Seoul (KR); Se Hyun Lyu, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 12/034,019

(22) Filed: Feb. 20, 2008

(65) Prior Publication Data

US 2008/0224388 A1 Sep. 18, 2008

(30) Foreign Application Priority Data

Mar. 15, 2007 (KR) ..... 10-2007-0025594

(51) Int. Cl.
*B65H 1/00* (2006.01)

(52) U.S. Cl. ..... 271/171

(58) Field of Classification Search ..... 271/171
See application file for complete search history.

(56) References Cited

U.S. PATENT DOCUMENTS 5,172,903 A * 12/1992 Haneda et al. ..... 271/171

OTHER PUBLICATIONS

Office Action, mailed Oct. 9, 2009, in corresponding Chinese Application No. 200810082882.5 (9 pp.).

* cited by examiner

*Primary Examiner*—David H Bollinger
(74) *Attorney, Agent, or Firm*—Staas & Halsey, LLP

(57) ABSTRACT

An image forming apparatus including a guide unit including: a length-adjusting assembly including a length-adjusting rack part, which is adjusted according to a length of printing medium; a width-adjusting assembly including a width-adjusting rack part, which is adjusted according to a width of printing medium; and a pinion assembly, which interlocks the width-adjusting assembly interlock with the length-adjusting assembly. The pinion assembly includes a first pinion part, which engages with the length-adjusting rack, and a second pinion part, which engages with the width-adjusting rack and rotates together with the first pinion part. The first pinion part and the second pinion part have a stepped shape.

15 Claims, 6 Drawing Sheets

IMAGE FORMING APPARATUS AND PAPER GUIDE UNIT THEREOF

CROSS-REFERENCE TO RELATED APPLICATION

This application claims the benefit of Korean Application No. 2007-25594, filed Mar. 15, 2007, in the Korean Intellectual Property Office, the disclosure of which is incorporated herein by reference.

BACKGROUND OF THE INVENTION

1. Field of the Invention

Aspects of the present invention relate to an image forming apparatus.

2. Description of the Related Art

An image forming apparatus prints an image on a printing medium, e.g., paper, according to an input image signal. As one type of the image forming apparatus, an electrophotographic color image forming apparatus is configured, such that a beam is scanned to a photosensitive body charged with a predetermined electric potential, to form an electrostatic latent image on the outer peripheral surface of the photosensitive body. The electrostatic latent image is developed into a visible image, by supplying a developer to the electrostatic latent image, and the visible image is transferred and fused to paper.

The image forming apparatus is provided with a paper supply unit, which supplies the paper on which the visible image will be formed. The paper supply unit generally includes a paper cassette, in which the paper is loaded, and a pickup roller, which picks up the paper loaded on the paper cassette sheet by sheet.

The paper cassette is configured such that a user can load various sizes of paper thereon, as needed. In order to use the various sizes of paper, it is necessary to register the paper, according to the kind of paper loaded on the paper cassette. Unless the paper is properly registered, according to the kind of paper loaded on the paper cassette, a paper skew or a double feeding of the paper may occur. Thus, the paper supply unit is provided with a length-adjusting member, which is mounted in the paper cassette, to be adjusted according to the length of the paper loaded in the paper cassette. The paper supply unit also includes a width-adjusting member, which is mounted in the paper cassette, to be adjusted according to the width of the paper.

In other words, the conventional image forming apparatus is constituted, such that when using the various sizes of paper, the length-adjusting member is adjusted adequately for the length of the paper, and then the width-adjusting member is adjusted adequately for the width of the paper. However, the above conventional image forming apparatus has problems separately performing the two adjusting processes, i.e., the first process of adjusting the length-adjusting member adequately for the length of the paper, and the second process of adjusting the width-adjusting member adequately for the width of the paper.

SUMMARY OF THE INVENTION

Aspects of the present invention relate to an image forming apparatus that is provided with a guide unit, which can also be adjusted adequately for a width of a paper, while the guide unit is adjusted adequately for the length of the paper. The paper is loaded in a paper cassette.

Additional aspects and/or advantages of the invention will be set forth in part in the description which follows and, in part, will be obvious from the description, or may be learned by practice of the invention.

In accordance with aspects of the present invention, provided is an image forming apparatus including a paper cassette in which paper is loaded, and a guide unit which registers the paper loaded in the paper cassette, according to a size of the paper. The guide unit includes: a length-adjusting assembly, which is provided with a length-adjusting rack part that is adjusted according to a length of the paper; a width-adjusting assembly, which is provided with a width-adjusting rack part, which is adjusted according to a width of the paper; and a pinion assembly, which makes the width-adjusting assembly interlock with the length-adjusting assembly, when the length-adjusting assembly is adjusted. The pinion assembly includes a first pinion part, which is engaged with the length-adjusting rack part, and a second pinion part, which is engaged with the width-adjusting rack part and rotates together with the first pinion part. The first pinion part and the second pinion part are formed in a stepped shape.

According to aspects of the present invention, the first pinion part and the second pinion part are configured as pinion gears, which have different diameters from each other, to adjust the width and the length adequately, for the size of the paper loaded in the paper cassette.

According to aspects of the present invention, the length-adjusting rack part includes a first rack gear, which is disposed on a left side of the first pinion part, and a second rack gear, which is disposed on a right side of the first pinion part.

According to aspects of the present invention, the first rack gear and the second rack gear include gear teeth. When the length-adjusting assembly is adjusted, according to the length of the paper loaded in the paper cassette, the width-adjusting assembly selectively interlocks with the gear teeth of the first rack gear and the gear teeth of the second rack gear, according to the width of the paper.

According to aspects of the present invention, the first rack gear and the second rack gear are arranged at non-opposing positions.

According to aspects of the present invention, the first rack gear and the second rack gear are provided with a length guide at ends thereof. The length guide closely contacts a rear end of the paper when the first rack gear and the second rack gear move.

According to aspects of the present invention, the width-adjusting rack part includes a third rack gear, which is disposed on a front side of the second pinion part, and a fourth rack gear, which is disposed on a rear side of the second pinion part.

According to aspects of the present invention, the third rack gear and the fourth rack gear are respectively provided with width guides at ends thereof. The width guides closely contact both sides of the paper, when the third rack gear and the fourth rack gear move.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
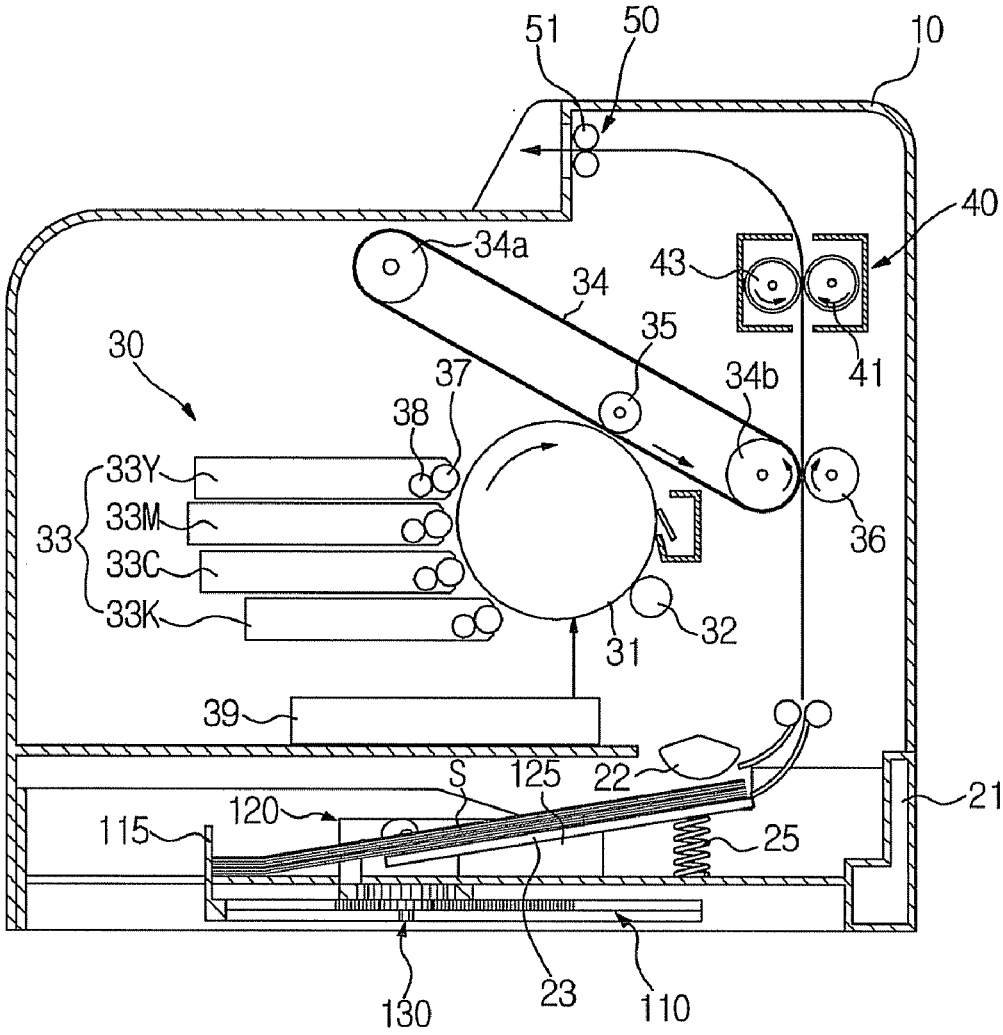
FIG. 1 is a sectional view illustrating the constitution of an image forming apparatus, in accordance with an exemplary embodiment of the present invention.

Reference will now be made in detail to exemplary embodiments of the present invention, examples of which are illustrated in the accompanying drawings, wherein like reference numerals refer to like elements throughout. The exemplary embodiments are described below, in order to explain the aspects of the present invention, by referring to the figures.

FIG. 1 is a sectional view schematically illustrating an image forming apparatus 90, in accordance with an exemplary embodiment. As shown in FIG. 1, the image forming apparatus 90 includes: a main body 10, which forms an exterior appearance and supports components mounted therein; a paper supply device 20, which supplies paper S to be printed; a developing device 30, which develops an image on the paper, a fusing device 40 which fuses the image to the paper by applying heat and pressure to the paper, and a paper discharge device 50, which discharges the printed paper to the outside of the main body 10. As referred to herein, the paper is any printing medium, such as, paper or transparency sheets.

The paper supply device 20 includes: a paper cassette 21, which is removably mounted to a lower portion of the main body 10; a paper tray 23, which is hinged, so as to move up and down in the paper cassette 21, and on which the paper S is loaded; an elastic member 25, which is provided below the paper tray 23, to elastically support the paper tray 23; and a pickup roller 22, which is provided near a front end of the paper S loaded on the paper tray 23, to pick up the paper S and feed the paper S to the developing device 30. The paper supply device 20 further includes: a guide unit 100, which registers the paper S loaded on the paper tray 23 in the paper cassette 21, to prevent the occurrence of skew or double feeding of the paper S, when the pickup roller 22 picks up the paper.

The developing device 30 includes: a photosensitive body 31, on which an electrostatic latent images are formed by an exposure member 39; a charge roller 32, which charges the photosensitive body 31; four developing cartridges 33, which develop the electrostatic latent images formed on the photosensitive body 31 into toner images, using yellow (Y), magenta (M), cyan (C) and black (K) developers; an intermediate transfer belt 34; a first transfer roller 35; and a second transfer roller 36. Hereinafter, to classify the components by colors, "Y", "M", "C", and "K" will be added after the reference numerals denoting the respective components.

Each of the developing cartridges 33 includes: a developing roller 37, which develops one of the electrostatic latent images formed on the photosensitive body 31, into the visible image, by supplying the developer to the electrostatic latent image; and a supply roller 38, which rotates while contacting the developing roller 37 and supplies the developer to the developing roller 37.

The intermediate transfer belt 34 is supported by supporting rollers 34*a* and 34*b*, and runs at the same velocity as the rotational linear velocity of the photosensitive body 31. The first transfer roller 35 opposes the photosensitive body 31, and transfers the visible images developed on the photosensitive body 31, onto the intermediate transfer belt 34, to form a print image. The second transfer roller 36 is disposed opposite to the intermediate transfer belt 34. While the visible images are transferred onto the intermediate transfer belt 34, from the photosensitive body 31, the second transfer roller 36 is spaced apart from the intermediate transfer belt 34. When the visible images are completely transferred onto the intermediate transfer belt 34, the second transfer roller 36 comes into contact with the intermediate transfer belt 34, at a prescribed pressure.

The fusing device 40 fuses the print image formed on the paper, via the developing device 30, to the paper by applying heat and pressure to the paper. The fusing device 40 includes a heat roller 41, which has a heat source therein, and a press roller 42, which is disposed opposite to the heat roller 41 and maintains the constant fusing pressure with the heat roller 41.

The paper discharge device 50 includes discharge rollers 51, which are sequentially mounted, so as to discharge the paper S having passed through the fusing device 40, to the outside of the main body 10.

Figure 2:
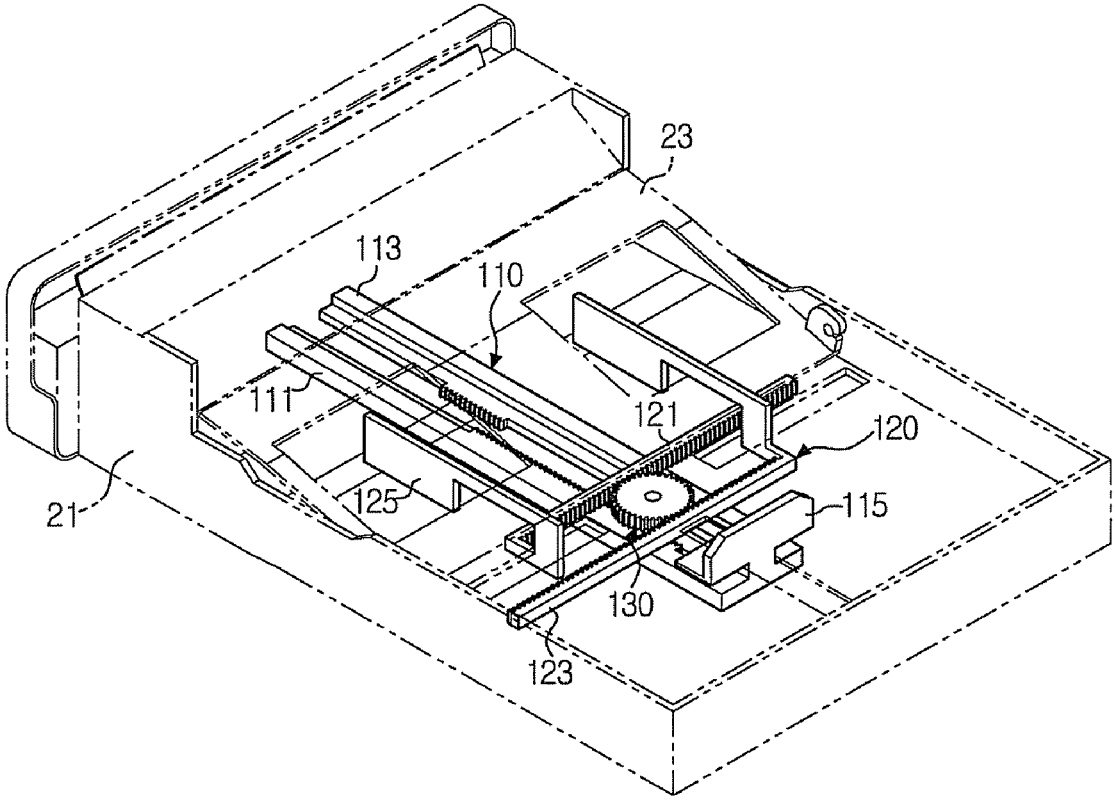
FIG. 2 is a perspective view illustrating a paper supply device depicted in FIG. 1.
Figure 3:
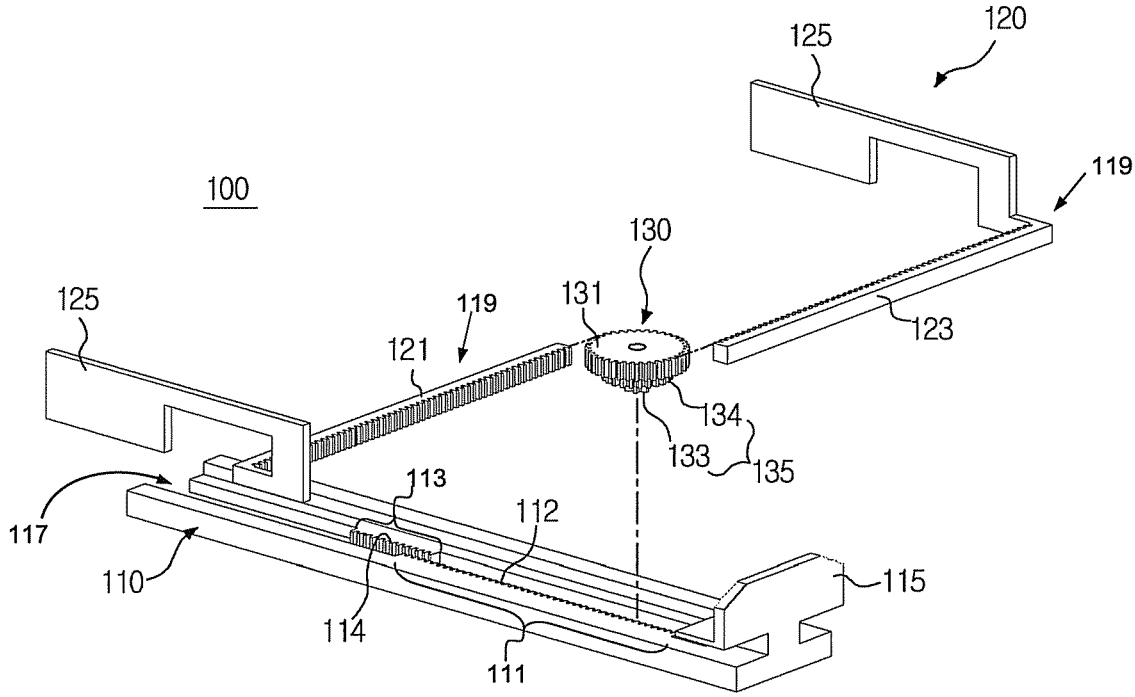
FIG. 3 is an exploded perspective view illustrating a guide unit depicted in FIG. 2.

FIG. 2 is a perspective view illustrating the paper supply device 90, and FIG. 3 is an exploded perspective view illustrating the guide unit 100 depicted in FIG. 2. Referring to FIGS. 2 and 3, the guide unit 100 registers the paper S loaded on the paper tray 23. The guide unit 100 includes: a length-adjusting assembly 110, which is adjusted according to the length of the paper S; a width-adjusting assembly 120, which is adjusted according to the width of the paper; and a pinion assembly 130, which makes the width-adjusting assembly 120 interlock with the length-adjusting assembly 110, when the length-adjusting assembly 110 is adjusted.

The length-adjusting assembly 110 includes a length guide 115, which is connected to and end thereof, and a length-adjusting rack part 117. The length-adjusting assembly 110 slides in the paper cassette 21 along a longitudinal direction. The length-adjusting rack part 117 includes a first rack gear 111 and a second rack gear 113 disposed generally parallel to one another. The first and second rack gears 111 and 113 can be offset in a vertical and a horizontal direction, and can be step-shaped, for example. The first rack gear 111 and the second rack gear 113 respectively include gear teeth 112 and 114, and are formed as steps protruding into the length-adjusting assembly 110. The first rack gear 111 and the second rack gear 113 do not oppose each other, so that the pinion assembly 130 engages with each of the rack gears 111 and 113 and can smoothly rotate. In other words, the pinion assembly 130 engages with one of the rack gears 111 and 113 at a time.

The guide unit 100 shown in FIGS. 2 and 3 can be loaded with, for example, B5, letter, or A4 paper. The gear teeth 112, of the first rack gear 111, engage the pinion assembly 130, when the guide unit 100 is adjusted to accommodate the letter paper or the B5 paper. The gear teeth 114, of the second rack gear 113, engage the pinion assembly 130, when the guide unit 100 is adjusted to accommodate the A4 paper or the letter paper. The lengths of the first and second rack gears 111 and 113 can correspond with widths of the different types of paper.

The length guide 115 is disposed at an end of the length adjusting assembly 110 and contacts an end of the paper S, when the length adjusting assembly 110 is adjusted. In other words, the length guide 115 can set a length for the paper P in the paper cassette 21.

The width-adjusting assembly 120 includes a width-adjusting rack part 119, which slides in the paper cassette 21 in a width direction, and width guides 125, which are connected to the width-adjusting rack part 119. The width-adjusting rack part includes a third rack gear 121 and a fourth rack gear 123, which are mounted on the bottom surface of the paper cassette 21, along the width direction, and at least partially oppose each other. The width guides 125 are respectively connected to an end of the third rack gear 121, to an end of the fourth rack gear 123, and contact both sides of the paper, when the with assembly is adjusted. In other words, the width guides 125 can set a width for the paper P in the paper cassette 21.

As described above, the pinion assembly 130 interlocks the width-adjusting assembly 120 with the length-adjusting assembly 110, to coordinate the respective movements thereof, when the length-adjusting assembly 110 is adjusted. The pinion assembly 130 includes: a first pinion part 135, which engages with the first rack gear 111 and the second rack gear 113; and a second pinion part 131, which engages with the third rack gear 121 and the fourth rack gear 123.

The second pinion part 131 is a pinion gear, which engages with both the third rack gear 121 and the fourth rack gear 123. The first pinion part 135 includes pinion gears 133 and 134, which are integrally formed beneath the second pinion part 131. The pinion gears 133 and 134 have different diameters. In other words, the pinion gears 133 and 134, of the first pinion part 135, are reduction gears. In some exemplary embodiments, the pinion assembly 130 can be referred to as a reduction gear.

The pinion gear 134, of the first pinion part 135, engages with the first rack gear 111, when adjusting the guide unit 100 for the letter paper, when the guide unit 100 was previously adjusted for the B5 paper The pinion gear 133, of the first pinion part 135, engages with the second rack gear 113, when adjusting the guide unit 100 for the letter paper, when the guide unit 100 was previously adjusted for the A4 paper.

Figure 4A:
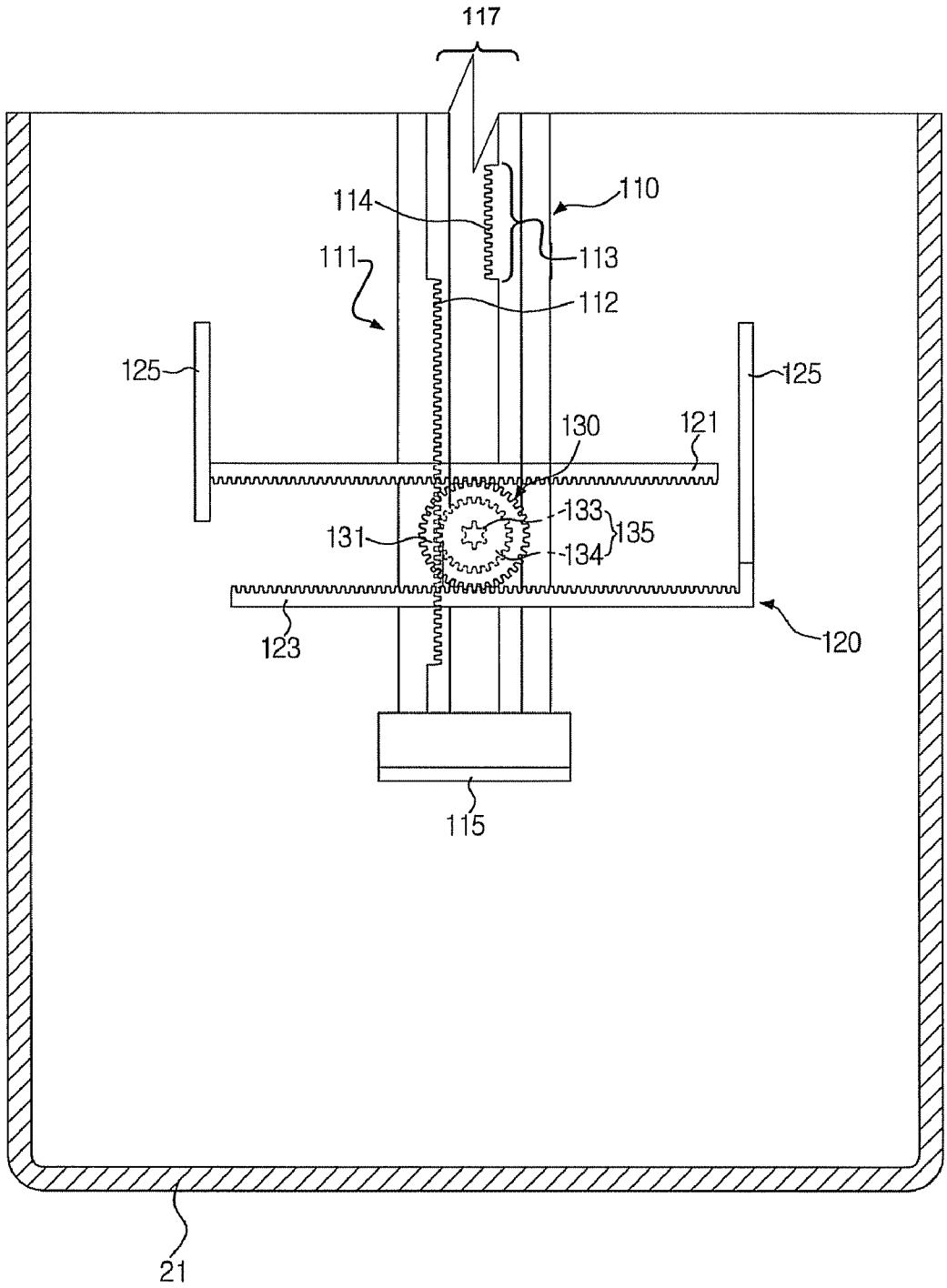
FIGS. 4A to 4C illustrate a process of adjusting the guide unit, according to a size of paper in the image forming apparatus, in accordance with an exemplary embodiment of the present invention.
Figure 4B:
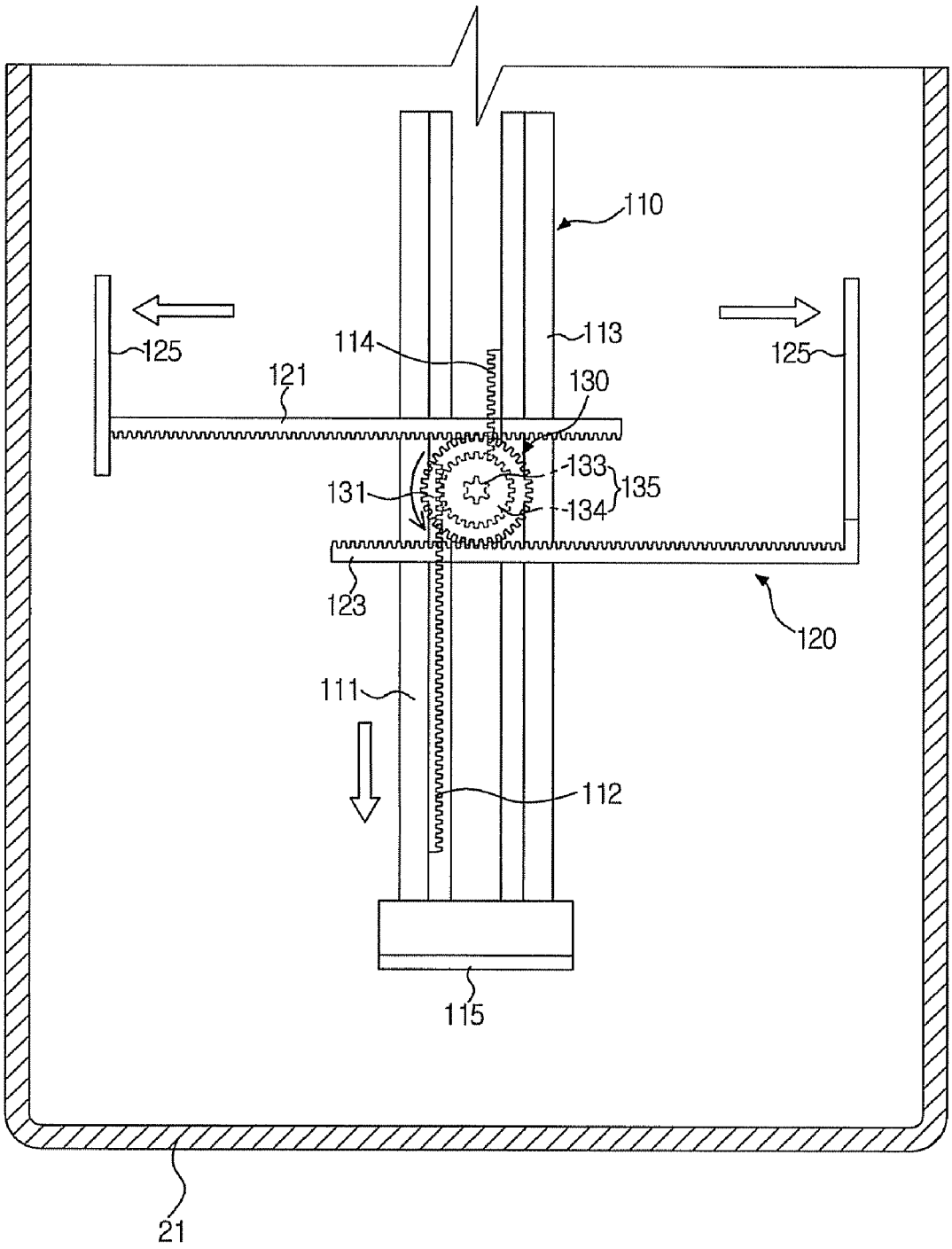
Figure 4C:
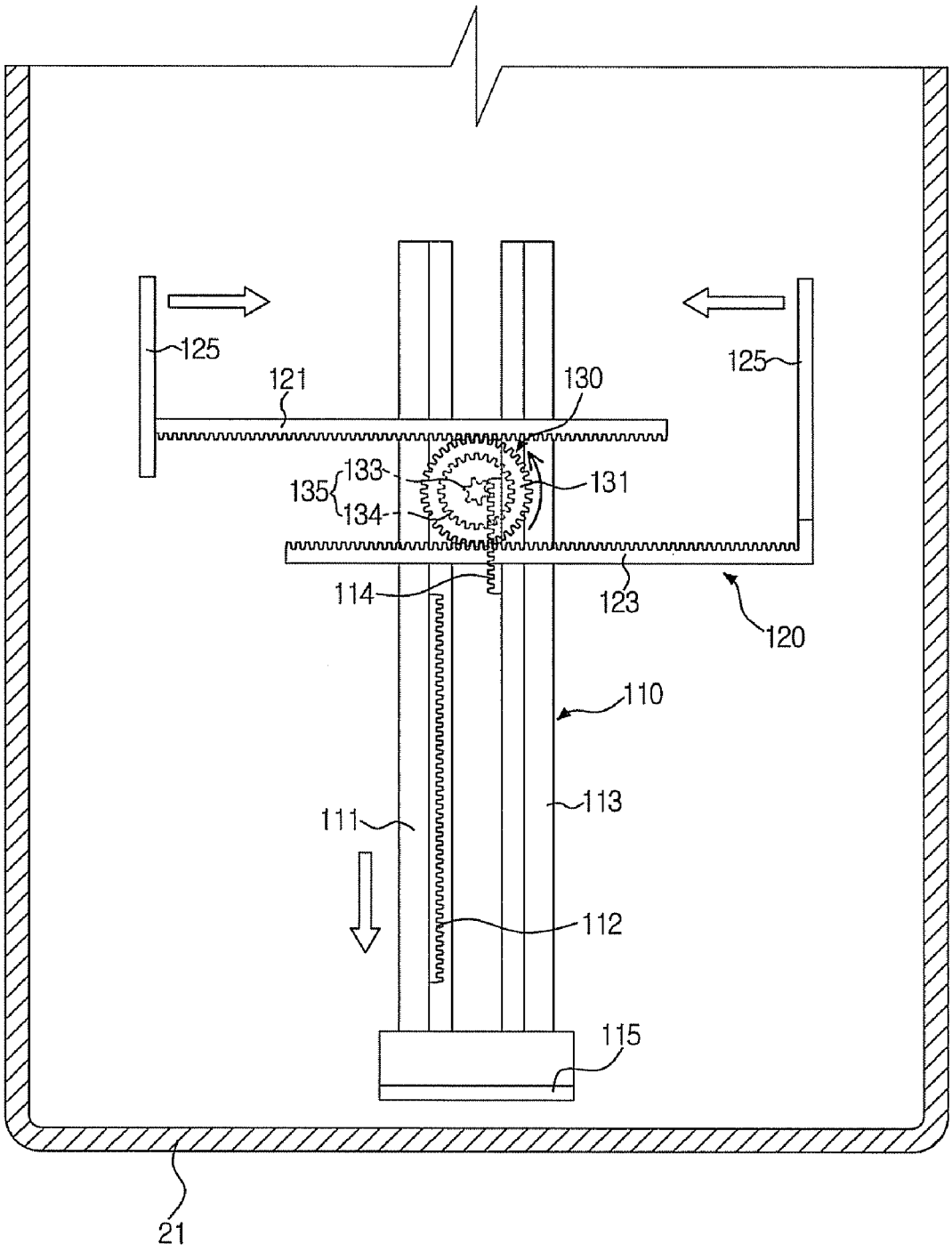

Hereinafter, the process of adjusting the length and the width of the guide unit 100, according to the size of the paper S, will be described with reference to FIGS. 4A to 4C. FIG. 4A is a view of the guide unit 100, when adjusted for the B5 paper, FIG. 4B is a view of the guide unit 100, when adjusted for the letter paper, and FIG. 4C is a view of the guide unit 100, when adjusted for the A4 paper. The B5 paper has a size of 176 mm×250 mm, the letter paper has a size of 216 mm×278 mm, and the A4 paper has a size of 210 mm×297 mm.

In order to adjust the guide unit 100, which has been previously adjusted for the B5 paper, for the letter paper, a user pulls the length guide 115 of the length-adjusting assembly 110 adequately for the letter paper, as shown in FIGS. 4A and 4B.

If the length guide 115 is pulled, the first rack gear 111 and the second rack gear 113, which are connected to the length guide 115, also move. When the first rack gear 111 moves, the pinion gear 134, of the first pinion part 135, which is engaged with the first rack gear 111, rotates in a counterclockwise direction.

If the pinion gear 134 rotates, the pinion gear of the second pinion part 131 also rotates, and the third and fourth rack gears 121 and 123, engaged with the second pinion part 131, extend outward. At this time, the third rack gear 121 and the fourth rack gear 123 extend outward an amount corresponding to the lengths thereof.

As described above, during the process of moving the length-adjusting assembly 110 of the guide unit 100, which has been adjusted for B5 paper, for the letter paper, the width-adjusting assembly 120 is interlocked and adjusted to the letter paper width, by the pinion assembly 130.

In order to adjust the guide unit 100, which has been adjusted for the letter paper, adequately for the A4 paper, a user pulls the length guide 115, to adjust the guide unit 100 for the A4 paper, as shown in FIGS. 4B and 4C.

If the length guide 115 is pulled, the first rack gear 111 and the second rack gear 113, which are connected to the length guide 115, also move. When the second rack gear 113 moves, the pinion gear 133 of the first pinion part 135, which is engaged with the second rack gear 113, rotates in a clockwise direction.

If the pinion gear 133 rotates, the pinion gear of the second pinion part 131 also rotates, and the third and fourth rack gears 121 and 123, engaged with the second pinion part 131, move inward. At this time, the third rack gear 121 and the fourth rack gear 123 move inward an amount corresponding to the range of the gear teeth 114, which are formed at the second rack gear 113.

As described above, during the process of adjusting the length-adjusting assembly 110 of the guide unit 100, which has been adjusted for the letter paper, for the A4 paper, the width-adjusting assembly 120 is interlocked and adjusted for the width of the A4 paper, by the pinion assembly 130.

The above exemplary embodiment shows and describes the process of adjusting the guide unit 100 from the adjustment for the B5 paper to the adjustment for letter paper and from the adjustment for the letter paper to the A4 paper, however, the guide unit 100 can be modified to be adjusted according to the various sizes of paper. To achieve this, the rack gears of the length-adjusting assembly can be formed with rack gears corresponding to the sizes of the respective kinds of paper, and the first pinion part of the pinion assembly can include the pinion gears having diameters corresponding to the sizes of the respective kinds of paper.

As is apparent from the above description, the image forming apparatus 90, according to an exemplary embodiment, can adjust the width-adjusting assembly 120 for a width of paper, while adjusting the length-adjusting assembly for a length of paper, according to the rotation of the pinion assembly 130, which interlocks the movements of the length-adjusting assembly 110 and the width-adjusting assembly 120. Accordingly, the process of adjusting the guide unit 100 the paper P loaded in the paper cassette 21, can be achieved easily.

Although a few exemplary embodiments of the present invention have been shown and described, it would be appreciated by those skilled in the art that changes may be made in these exemplary embodiments without departing from the principles and spirit of the invention, the scope of which is defined in the claims and their equivalents.

What is claimed is:

1. An image forming apparatus, comprising:

a paper cassette, in which a printing medium is loaded; and a guide unit which registers the printing medium loaded in the paper cassette, according to a size of the printing medium, wherein the guide unit comprises:

a length-adjusting assembly to register the printing medium lengthwise, comprising a length-adjusting rack part;

a width-adjusting assembly to register the printing medium widthwise, comprising a width-adjusting rack part; and a pinion assembly having a stepped shape to interlock the length-adjusting assembly and the width-adjusting assembly, comprising a first pinion part to engage with the length-adjusting rack part, and a second pinion part to engage with the width-adjusting rack part, wherein the length-adjusting rack part comprises a first rack gear to engage with a first side of the first pinion part, and a second rack gear to engage with a second side of the first pinion part.

2. The image forming apparatus according to claim 1, wherein the first pinion part and the second pinion part are pinion gears, which have different diameters.

3. The image forming apparatus according to claim 1, wherein when the length-adjusting assembly registers the printing medium-, the width-adjusting assembly is selectively interlocked with the first rack gear and the second rack gear, according to a width of the printing medium.

4. The image forming apparatus according to claim 1, wherein the first rack gear and the second rack gear are disposed in the length-adjusting assembly at non-opposing positions.

5. The image forming apparatus according to claim 1, wherein the length-adjusting assembly further comprises a length guide disposed at an end thereof, to contact an end of the printing medium, when the length-adjusting assembly registers the printing medium.

6. The image forming apparatus according to claim 1, wherein the width-adjusting rack part comprises a third rack gear to engage with a first side of the second pinion part and a fourth rack gear to engage with a second side of the second pinion part.

7. The image forming apparatus according to claim 6, wherein width adjusting assembly further comprises width guides disposed on ends of the third rack gear and the fourth rack gear, and the width guides contact opposing sides of the printing medium when the width-adjusting assembly registers the printing medium.

8. The image forming apparatus according to claim 1, wherein the pinion assembly engages with only one of the first rack gear and the second rack gear at a time.

9. A guide unit of a paper cassette, of an image forming apparatus, the guide unit comprising:

a length-adjusting assembly to register a printing medium lengthwise, comprising first and second rack gears disposed generally parallel to, and offset from, one another;

a width-adjusting assembly to register the printing medium widthwise, comprising third and fourth rack gears; and a pinion assembly to interlock the length-adjusting assembly and the width-adjusting assembly, comprising:

a first pinion gear to engage with the first rack gear;

a second pinion gear to engage with the second rack gear; and a third pinion gear to engage with the third and fourth rack gears, wherein the pinion assembly engages with only one of the first and second rack gears at a time.

10. The guide unit of claim 9, wherein the length-adjusting assembly further comprises a length guide disposed at an end thereof, to contact an end of the printing medium, when the length-adjusting assembly registers the printing medium.

11. The guide unit of claim 9, wherein width-adjusting assembly further comprises width guides disposed on ends of the third rack gear and the fourth rack gear, to contact opposing sides of the printing medium, when the width-adjusting assembly registers the printing medium.

12. The guide unit of claim 9, wherein the diameter of the third pinion gear is greater than the diameter of the second pinion gear, and the diameter of the second pinion gear is greater than the diameter of the first pinion gear.

13. The guide unit of claim 9, wherein the pinion assembly is a reduction gear.

14. The guide unit of claim 9, wherein the first rack gear and the second rack gear are offset in a horizontal direction and a vertical direction.

15. The guide unit of claim 9, wherein when the length-adjusting assembly is moved in a first direction, the pinion assembly rotates in a clockwise direction when engaged with the first rack gear and rotates in a counter clockwise direction when engaged with the second rack gear.

* * * * *

UNITED STATES PATENT AND TRADEMARK OFFICE

CERTIFICATE OF CORRECTION

PATENT NO. : 7,654,518 B2
APPLICATION NO. : 12/034019
DATED : February 2, 2010
INVENTOR(S) : Jong Tae Kim et al.

It is certified that error appears in the above-identified patent and that said Letters Patent is hereby corrected as shown below:

Column 7, Line 12, change "medium-," to --medium,--.

Signed and Sealed this

Fifteenth Day of June, 2010

David J. Kappos

David J. Kappos
*Director of the United States Patent and Trademark Office*